US006434894B2

(12) United States Patent
Reymann

(10) Patent No.: US 6,434,894 B2
(45) Date of Patent: Aug. 20, 2002

(54) FORMWORK FOR PREFABRICATED CONCRETE PARTS

(75) Inventor: Wolfgang Reymann, Hockenheim (DE)

(73) Assignee: Reymann Technik GmbH, Hockenheim (DE)

( * ) Notice: Subject to any disclaimer, the term of this patent is extended or adjusted under 35 U.S.C. 154(b) by 55 days.

(21) Appl. No.: 09/727,308

(22) Filed: Nov. 30, 2000

(30) Foreign Application Priority Data

Dec. 1, 1999 (DE) ..... 299 20 866 U

(51) Int. Cl.[7] ..... B28B 7/00

(52) U.S. Cl. ..... 52/127.7; 52/127.5; 52/127.1; 249/139; 249/163; 249/160; 425/DIG. 33

(58) Field of Search ..... 249/160, 139, 249/155, 163; 425/3, DIG. 33; 52/127.1, 127.5, 127.7

(56) References Cited

U.S. PATENT DOCUMENTS 6,082,701 A * 7/2000 Reymann ..... 249/160

FOREIGN PATENT DOCUMENTS

DE 4327696 * 2/1995
EP 0 512 437 A1 11/1992
EP 0 842 339 B1 5/1998

* cited by examiner

*Primary Examiner*—Carl D. Friedman
*Assistant Examiner*—Jennifer I. Thissell
(74) *Attorney, Agent, or Firm*—Akin, Gump, Strauss, Hauer & Feld, L.L.P.

(57) ABSTRACT

A formwork system is provided for prefabricated concrete parts, wherein a magnetic body can be set with its underside on a base plate and over which formwork parts can be fixed in their respective position. The formwork part has a lift-off stirrup engaging over the magnetic body, and between the lift-off stirrup and the cover side of the magnetic body facing away from the base plate there is a slot into which the magnetic body is retractable with a lifting element. This formwork system is characterized by a retaining elements which are releasably coupled on the magnetic body when it is retracted into the slot. This has the advantage that, by the couplable retaining elements, the magnetic body is securely fixed in the lift-off stirrup in its retracted state. Preferably, the coupling elements are constructed as magnetic and adhesion surfaces, which are arranged in the region of the slot between the magnetic body and lift-off stirrup.

15 Claims, 4 Drawing Sheets

FORMWORK FOR PREFABRICATED CONCRETE PARTS

BACKGROUND OF THE INVENTION

The invention relates to a formwork system for prefabricated concrete parts, having a magnetic body, which can be placed with its underside on a base plate, and on which the formwork parts are to be fixed in their respective position, wherein the formwork part has a lift-off stirrup engaging over the magnetic body, and there is a gap between the stirrup and the cover side of the magnetic body facing away from the base place, into which gap the magnetic body can be drawn via a lifting element.

Such a formwork system is known, for example, from European Patent EP-0 842 339 B1. There a formwork system is described, in which the lifting element is formed by a lifting rod, which is permanently braced on the lift-off stirrup by the interposition of a spring. Such springs must be exactly adjusted to the respective application case, which represents a certain expense. If a magnetic body is not properly lowered, the springs described there can also bring about its relifting.

BRIEF SUMMARY OF THE INVENTION

An object of the present invention is accordingly to further develop a formwork system of this type such that, on the one hand, a lower expenditure is necessary in designing the system and on the other hand, the effect of an unintentional, automatic relifting no longer occurs. In sum, the operating safety of the system overall should thereby be improved.

This objective is accomplished according to the invention, in that retaining elements are present, which are to be releasably coupled to the magnetic body when this is drawn into the slot.

The invention has the advantage that, by the releasable retaining elements, the magnetic body in its retracted state is fixed securely in the lift-off stirrup without spring elements being necessary for this. But due to the releasability, it is at the same time assured that the magnetic bodies can again be securely placed on the base plate.

It is advantageous if the coupling of the retaining elements in their raised state takes place automatically, wherein particularly the coupling while overcoming a pressure point offers the advantage that a tangible feedback about a successful secure raising and coupling is communicated to an operator.

Basically, the forces applicable here from the coupled retaining element to the raised magnetic body should be greater that its own weight, so as to guarantee that, after raising the magnetic body and coupling it, the formwork can be securely handled without major problems.

A possible coupling element is represented by magnets and adhesion surfaces, which are arranged in the area of the gap between magnetic body and lift-off stirrup. The magnets can here be integrated into the magnetic body, but in particular also be formed by its cover side. In order to restrict the coupling force, the adhesion surface has a smaller planar extension than the cover side.

One possibility for restricting the planar extension of the adhesion surface is to use for this the front face of web plates arranged in the slot. These are in total so small in their dimensions, that the danger does not even exist that a foreign object, for example a small stone or the like, would get between the adhesion surface and magnetic bodies, which would impede coupling.

With other types of coupling elements, it is a question of spring means hooking in under a rebound, wherein these in particular engage the lifting element. Here, for example, it is a matter of a springy latching element, which engages into a corresponding latching groove on the lifting element and then fixes this in the raised position. It is also conceivable, however, to allow appropriate spring elements to engage directly on the magnetic body, whereby it is possible, for example, to draw the magnetic body over, for example, projections situated on the side walls of the lift-off stirrup.

Projections of this type can instead be provided on a guide running around the magnetic body inside the lift-off stirrup, wherein such a guide is to be used particularly when the lift-off stirrup is integrated into a formwork part and the width of a magnetic body is smaller than the width of the formwork system. In such cases, a greater free space is granted to the builder in designing the formwork with the guide, which is adapted to the magnetic body in its free width. A guide of this type can advantageously also even have a stripping edge facing the magnetic body, by which concrete or the like adhering to the magnetic body is to be stripped off, so that the magnetic body is continuously cleaned, and the formwork system consequently requires less maintenance.

Here a slight play is provided between the magnetic body and the stripping edge, so that the magnetic body cannot tilt and jam inside the guide between stripping edges.

Advantageously the guide is constructed overall such that it forms with the lift-off stirrup a substantially closed space, into which the magnet is to be raised. This substantially closed space is likewise advantageous or requires little maintenance for the formwork system.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited of the precise arrangements and instrumentalities shown. In the drawings.

DETAILED DESCRIPTION OF THE INVENTION

Figure 1:
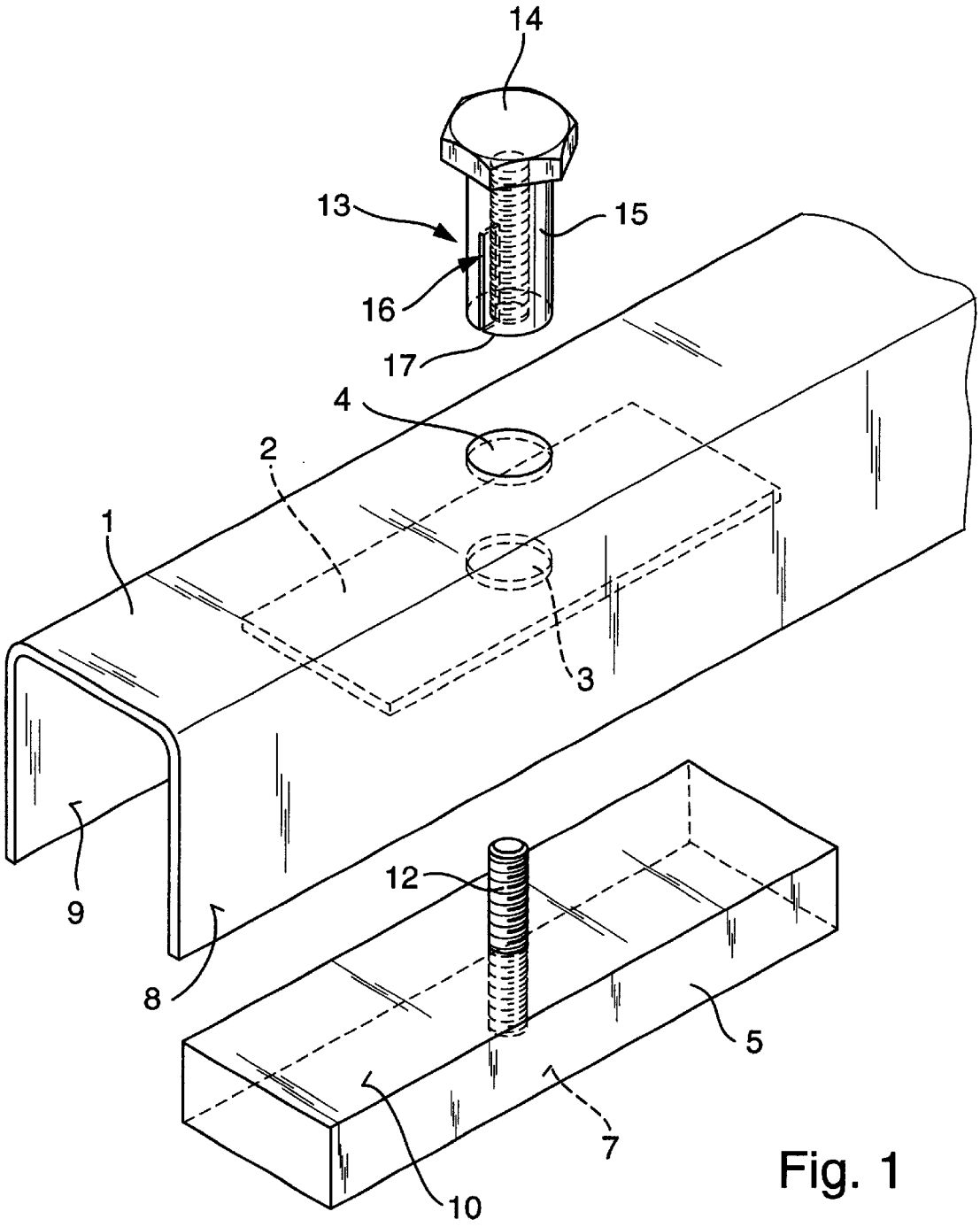
FIG. 1 is an exploded representation of a formwork system of the invention.

In FIG. 1 one will recognize a formwork part 1, which is U-shaped in cross section and open toward the bottom. An adhesion surface 2 is welded into this formwork part, which has a central bore hole 3. This bore hole is aligned with a further bore hole 4 on the upper side of the formwork part 1.

Figure 2:
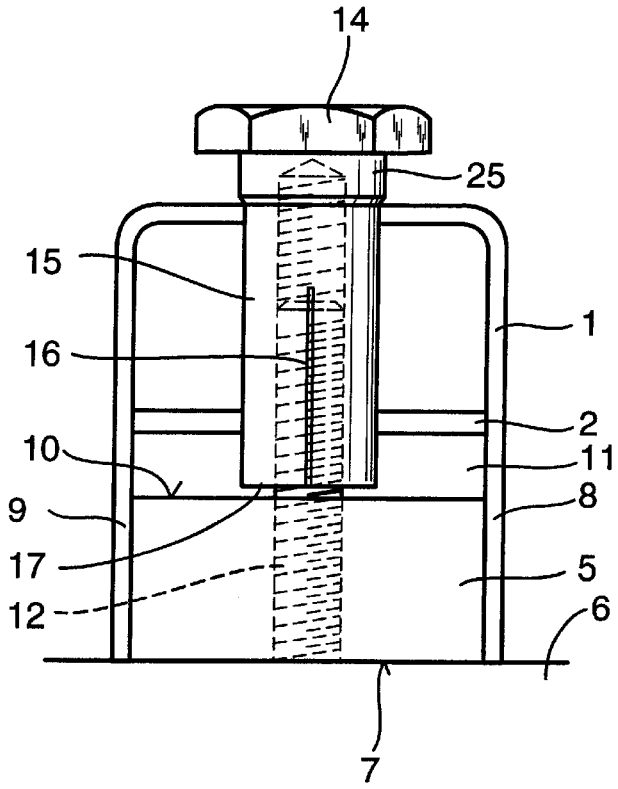
FIG. 2 is an end view of a formwork system according to FIG. 1 with lowered magnetic body.

Below the adhesion surface 2 a substantially cuboidal magnetic body 5 can be inserted. As can be seen from FIG. 2, the height of the magnetic body 5 is lower than the distance from the adhesion surface 2 to a base plate 6, which is made of steel and on which the magnetic body 5 is to be placed with its underside 7 adhering. Here, the width of the magnetic body 5 is exactly adjusted to the distance between the legs 8 and 9 of the U shaped formwork part 1, so that the formwork part 1 is fixed in its position on the base plate 6, when it is inverted on the magnetic body 5.

By the adhesion surface 2 and the segments of the lateral legs 8, 9 of the formwork part 1 running downward from it to the base plate 6, a lift-off stirrup is formed. Between the lift-off stirrup and the cover side 10 of the magnetic body facing away from the base plate 6, a gap 11 is consequently formed, into which the magnetic body 5 can be drawn. For drawing in, a threaded rod 12 is provided in the present case as a lifting element, which is screwable on its one end into the magnetic body 5, and on its other end corresponds with a sleeve 13. This sleeve 13 and the threaded rod 12 are guided through the above mentioned bore holes 3 and 4. The sleeve 13 has on its upper end a head 14, which can be gripped under with a tool, on whose lower end a threaded shaft 15 is connected. This threaded shaft 15 is provided with a slot 16 parallel to the axis of the shaft 15.

Figure 3:
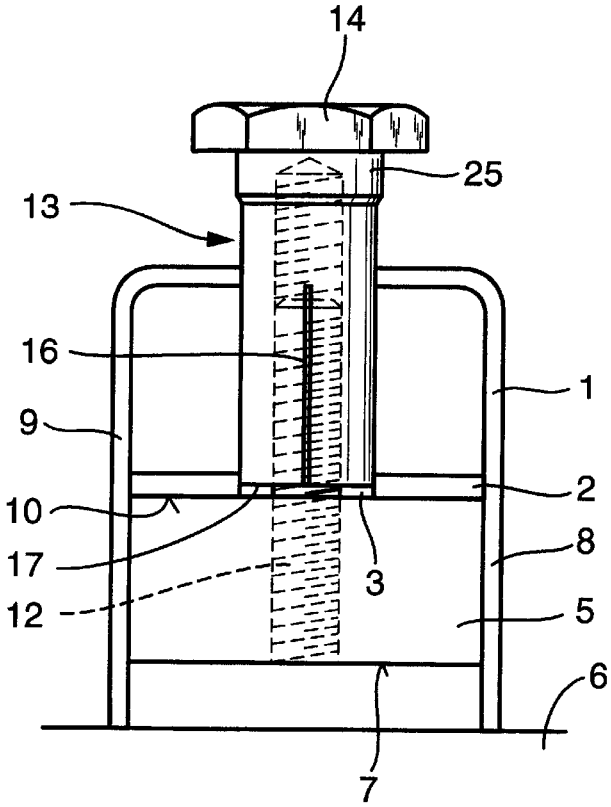
FIG. 3 is an end view of a formwork system according to FIG. 1 with raised magnetic body.

The functioning of the formwork system described up until now in its individual elements is as follows: In order to lift the magnetic body 5, sitting as described above on the base plate 6, the head 14 of the sleeve 13 is raised with an appropriate tool which grips under it, whereby the magnetic body 5 is pulled away from the base plate 6 by the threaded rod 12. When it is raised, the magnetic adhesion forces acting upon the magnetic body 5 diminish with its distance from the base plate until it reaches with its cover side 10 the attraction region of the likewise magnetic adhesion surface 2. In this connection then, with diminishing distance increasing attractive forces arise, which are perceived by an operator as overcoming a pressure point. Finally, as can be recognized in FIG. 3, the cover side 10 of the magnetic body 5 then comes into contact with the adhesion surface 2, on which the magnetic body 5 then remains adhering due to the magnetic attraction forces acting between the magnetic body 5 and the adhesion surface 2. During the lifting motion the magnetic body 5 is correspondingly guided by the legs 8, 9 of the formwork part 1 or by the interaction of the sleeve 13 with the bore holes 3 and 4.

By the contact of the cover side 10 existing in magnetic adhesion with the adhesion surface 2, the magnetic body 5 is then fixed against the force of gravity acting on it. Only when the sleeve 13 is moved downward, for example when a downward pressure is exerted on the head 14 with a hammer or with a foot, does the magnetic body 5 again separate from the adhesion surface 2 and fall downward, where it again sets itself on the base plate 6 and again correspondingly fixes the formwork part 1 in its position.

Since the size of the adhesion surface 2 is restricted, the magnetic force of adhesion is equally restricted, and indeed to a fraction of the possible adhesive forces between the magnetic body and base plate. Here it should particularly be considered that the illustrated magnet has a cover and develops considerably smaller magnetic forces toward the adhesion surface 2 than toward the base plate 6. Consequently, a lowering of the magnetic body is considerably easier than raising it.

If in an alternative embodiment of the formwork part, the above described adhesion surface 2 should be made of light metal, for example, and consequently not be magnetic, then the lower edge 17 of the sleeve 13 can be so constructed that it is hooked with the magnetic body 5 drawn into the slot 11 between the cover side 10 of the magnetic body and the underside of the adhesion surface 2 with the rim of the central bore hole 3 due to a possible springing out by the slot 16. Thus, a retaining element is to be realized which, when the drawn-in magnetic body couples on to this and has the hooking on spring elements. By a corresponding pressure on the head 14, the here provided latching of the lower edge 17 can then be separated again from the rim of the bore hole 3.

It is obviously also possible to provide as a retaining element in the region of the bore hole 3 a locking pin which acts radially on the sleeve 13, wherein then outside on the threaded shaft 15 of the sleeve 13, a corresponding latching groove or the like should be provided.

Appropriate latching elements can also basically act directly on the magnetic body 5 in the raised state. This is not illustrated here.

Figure 4:
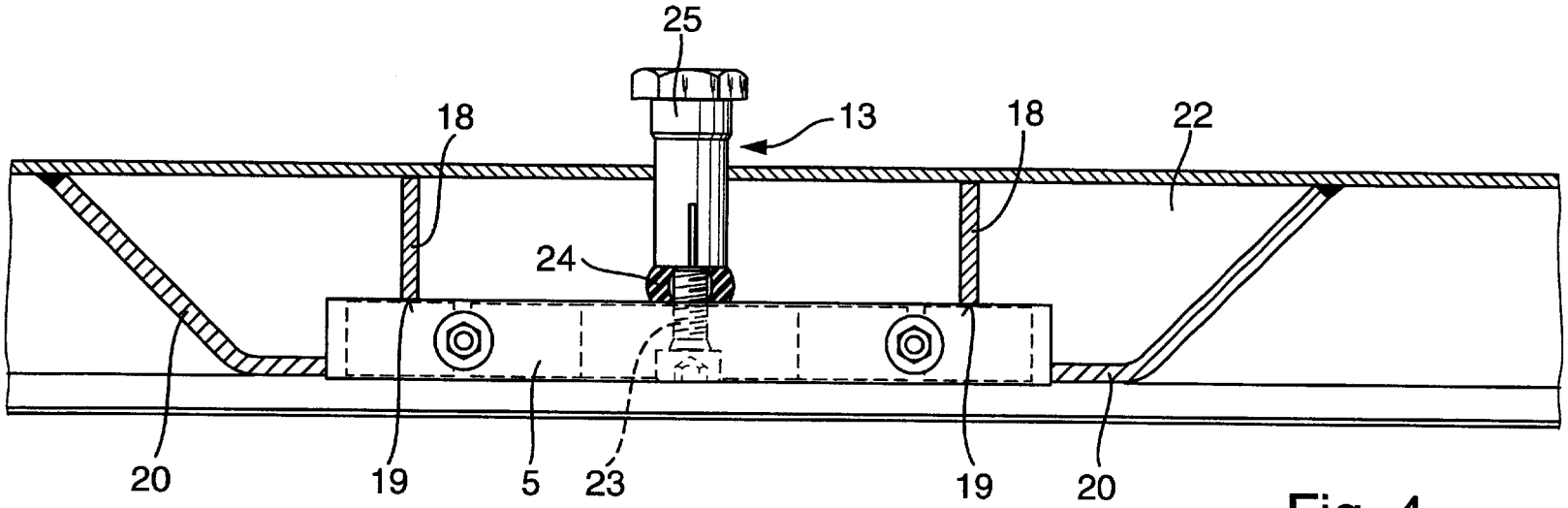
FIG. 4 is a side view in section of a formwork system having a guide with raised magnetic body.

In FIG. 4 yet another alternative embodiment is depicted. First, one recognizes that instead of a large adhesion surface 2, as represented in FIG. 1, merely web plates 18 are provided, whose end faces 19 then form the adhesion surfaces. These adhesion surfaces 19 are considerably smaller than as described above, wherein in the example represented here, the magnetic body 5 has no cover, and consequently the adhesion forces developed toward the upper side as well as toward the underside are substantially equal. Only through the very small size of the end faces 19 is a lower adhesive force consequently attained in the elevated state of the magnetic body 5.

Figure 5:
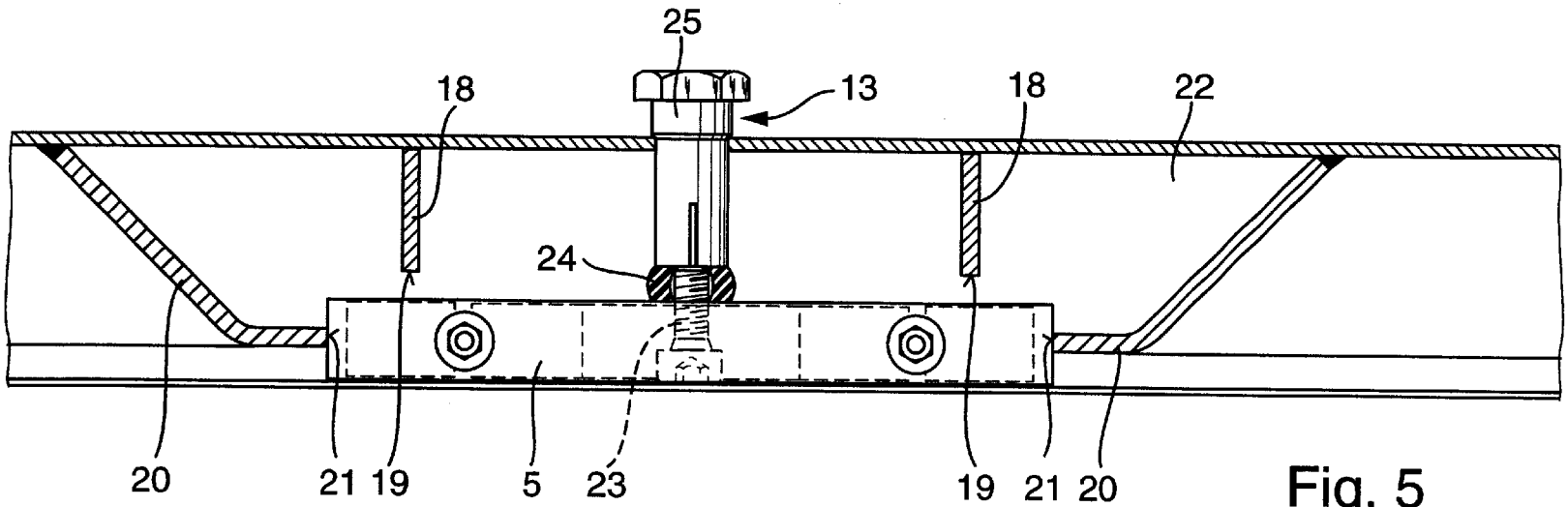
FIG. 5 is a side view in section of a formwork system having a guide with lowered magnetic body.
Figure 6:
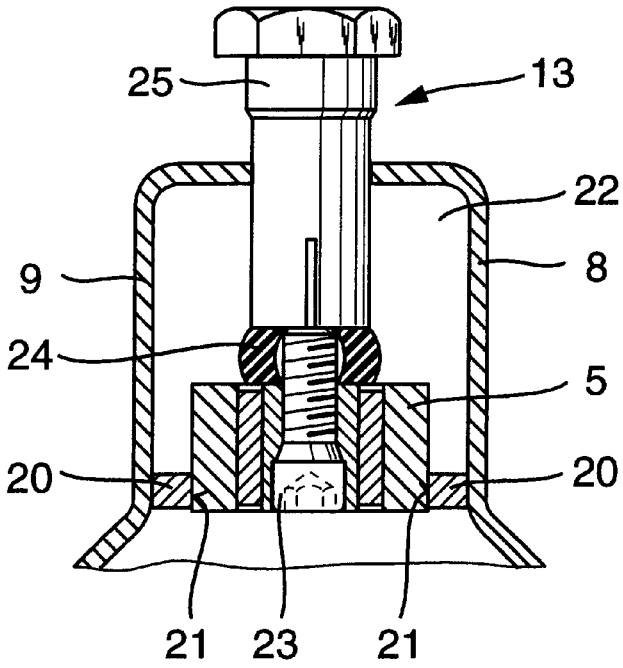
FIG. 6 is an end view in section of a formwork system according to FIG. 4 with raised magnetic body.
Figure 7:
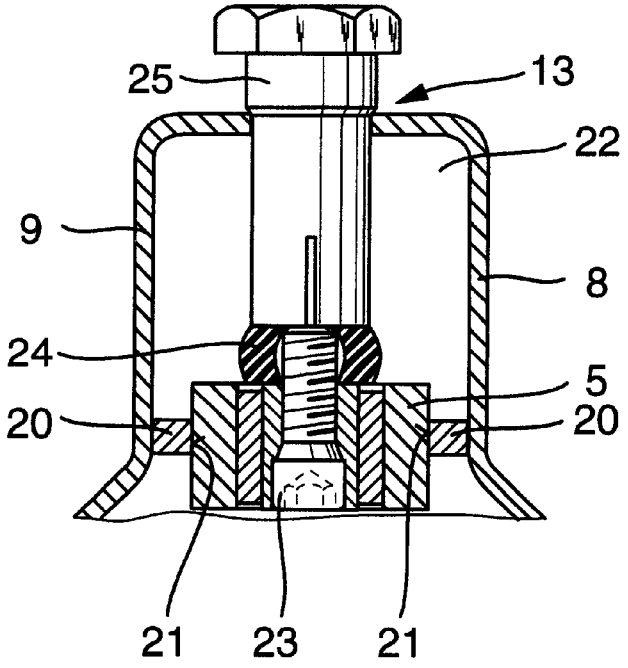
FIG. 7 is an end view in section of a formwork system according to FIG. 5 with lowered magnetic body.

In FIGS. 4–6 one recognizes there that, inside the lift-off stirrup, a sheet is inserted as a guide 20, which encloses the magnetic body 5 on its entire periphery. By this guide the lateral legs 8 or 9 can have any desired distance from each other, without this having an influence on the width of the magnetic body 5. This is namely held by the guide 20 and not by the inner sides of the mentioned legs.

The illustrated guide 20 has all around a stripping-off edge 21 facing the magnetic body 5. The magnetic body 5 is drawn past this during raising or lowering, so that any concrete adhering on the side surfaces of the magnetic body 5 is stripped off.

Here, there is in any given case a certain play between the side walls of the magnetic body 5 and the stripping-off edge 21 which, on the one hand, prevents the magnetic body 5 from jamming due to a tipping in the guide 20. On the other hand, due to this very slight play, a slight lateral striking of the stripping-off edges 21 on the lateral surfaces of the magnet body 5 is also possible, by which adhering concrete is to be knocked off.

Herein, this play is so small, however, that it is assured that no dirt or the like can reach through it into the area above the guide 20, where between this guide and the lift-off stirrup a substantially closed space 22 is formed, which is relatively well protected from aggressive environmental influences in connection with concrete formwork.

It should still be mentioned here that, in the embodiments represented in FIGS. 4–6, the magnetic body 5 is connected with the sleeve 13 with a hexagonal recess cap screw 23. It is thereby assured by an elastomeric ring element 24 that a screwing in of this hexagonal recess cap screw into the sleeve 23 is only possible when the hexagonal recess cap screw is held firmly by a hexagonal recess cap screw wrench while rotating the sleeve 13. Otherwise, the hexagonal recess cap screw 23 turns together with the sleeve 13, so that thus the lifting element for the magnets 5 formed by the sleeve 13 and hexagonal recess cap screw 23 is not shifted in its length. This is important, since by the step 25 formed on the sleeve 13, the formwork part is drawn firmly to the base plate 6, when the magnetic body 5 sits on the base plate 6.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A formwork system for concrete parts, comprising a magnetic body (5) which can be set with its underside (7) on a base plate (6) and over which formwork parts (1) can be fixed in their respective position, wherein the formwork part (1) has a lift-off stirrup (9, 2, 8) engaging over the magnetic body (5), the lift-off stirrup and a cover side (10) of the magnetic body (5) facing away from the base plate (6) forming a slot (11) therebetween, into which the magnetic body (5) is retractable by a lifting element (12, 13), and wherein a retaining element (2) is present which is releasably coupled to the magnetic body (5), when the magnetic body (5) is retracted into the slot (11).

2. The formwork system according to claim 1, wherein the coupling of the retaining element takes place automatically.

3. The formwork system according to claim 1, wherein the coupling takes place upon overcoming a pressure point.

4. The formwork system according to claim 1, wherein forces applicable from the coupled retaining element (2) are greater than an independent weight of the magnetic body (5).

5. The formwork system according to claim 1, wherein the coupling takes place between magnets and an adhesion surface (2) in a region of the slot (11).

6. The formwork system according to claim 5, wherein the magnets are integrated into the magnetic body (5) and are formed by a cover side (10) of the magnetic body (5).

7. The formwork system according to claim 6, wherein the adhesion surface (2) has a smaller planar extension than the cover side (10) of the magnetic body (5).

8. The formwork system according to claim 7, wherein the adhesion surface (2) comprises end faces (19) of web plates (18) arranged in the slot (11).

9. The formwork system according to claim 1, wherein the retaining element has hooking spring elements.

10. The formwork system according to claim 9, wherein the spring elements engage with the lifting element (13).

11. The formwork system according to claim 9, wherein the spring elements engage with the magnetic body (5).

12. The formwork system according to claim 1, wherein the lift-off stirrup is provided with a guide (20) running around the magnetic body (5).

13. The formwork system according to claim 12, wherein the guide (20) has a stripping-off edge (21) facing the magnetic body (5).

14. The formwork system according to claim 13, wherein there is play between the magnetic body (5) and the stripping-off edge (21).

15. The formwork system according to claim 12, wherein a substantially closed space (22) is formed between the guide (20) and lift-off stirrup.

* * * * *